US008994474B2

(12) United States Patent
Mahon et al.

(10) Patent No.: US 8,994,474 B2
(45) Date of Patent: Mar. 31, 2015

(54) ORTHO-MODE TRANSDUCER WITH WIDE BANDWIDTH BRANCH PORT

(75) Inventors: John P. Mahon, Thousand Oaks, CA (US); Cynthia P. Espino, Carlsbad, CA (US)

(73) Assignee: Optim Microwave, Inc., Camarillo, CA (US)

( * ) Notice: Subject to any disclaimer, the term of this patent is extended or adjusted under 35 U.S.C. 154(b) by 369 days.

(21) Appl. No.: 13/453,913

(22) Filed: Apr. 23, 2012

(65) Prior Publication Data

US 2013/0278352 A1 Oct. 24, 2013

(51) Int. Cl.

| | |
|---|---|
| ***H01P 1/165*** | (2006.01) |
| ***H01P 5/12*** | (2006.01) |
| ***H01P 1/161*** | (2006.01) |
| ***H01P 1/213*** | (2006.01) |

(52) U.S. Cl.

CPC ..... *H01P 1/161* (2013.01); *H01P 1/213* (2013.01)

USPC ..... 333/137

(58) Field of Classification Search

CPC ..... H01P 1/213

USPC ..... 333/137

See application file for complete search history.

(56) References Cited

U.S. PATENT DOCUMENTS

| | | | | |
|---|---|---|---|---|
| 2,716,221 | A | 8/1955 | Allen | |
| 2,783,439 | A | 2/1957 | Whitehorn | |
| 2,850,705 | A * | 9/1958 | Chait et al. | 333/24.3 |
| 3,164,789 | A | 1/1965 | Grosbois et al. | |
| 3,201,717 | A | 8/1965 | Grosbois et al. | |
| 3,758,882 | A | 9/1973 | Morz | |
| 3,932,822 | A | 1/1976 | Salzberg | |
| 4,523,160 | A | 6/1985 | Ploussios | |
| 4,613,836 | A | 9/1986 | Evans | |
| 4,725,795 | A | 2/1988 | Ajioka et al. | |
| 4,806,945 | A | 2/1989 | Cormier et al. | |
| 4,849,720 | A | 7/1989 | Call | |

(Continued)

OTHER PUBLICATIONS

Anton M. Boifot, Classification of Ortho-Mode Transducers, European Transactions on Telecommunications, Sep. 1991, vol. 2, No. 5, pp. 503-510.

(Continued)

*Primary Examiner* — Stephen E Jones
*Assistant Examiner* — Scott S Outten
(74) *Attorney, Agent, or Firm* — SoCal IP Law Group LLP; John E. Gunther; Steven C. Sereboff

(57) ABSTRACT

An ortho-mode transducer may include a cylindrical common waveguide terminating in a common port, a rectangular vertical branch waveguide in-line with the cylindrical common waveguide and terminating in a vertical port, and a rectangular horizontal branch waveguide normal to the common waveguide and terminating in a horizontal port. The vertical branch waveguide may be configured to couple a first linearly polarized mode from the vertical port to the common waveguide. The horizontal branch waveguide may be configured to couple a second linearly polarized mode, orthogonal to the first linearly polarized mode, from the horizontal port to the common waveguide. A portion of the vertical branch waveguide may overlap a portion of the cylindrical common waveguide. A septum may span the vertical branch waveguide proximate to the overlapping portions of the vertical branch waveguide and the common waveguide. A rectangular symmetry cavity may be opposed to the horizontal branch waveguide.

7 Claims, 10 Drawing Sheets

(56) References Cited

U.S. PATENT DOCUMENTS

| | | | |
|---|---|---|---|
| 4,951,010 | A | 8/1990 | Grim |
| 4,982,171 | A | 1/1991 | Figlia et al. |
| 5,376,905 | A | 12/1994 | Kich |
| 5,392,008 | A | 2/1995 | Wong |
| 6,087,908 | A | 7/2000 | Haller et al. |
| 6,166,610 | A | 12/2000 | Ramanujam et al. |
| 6,225,875 | B1 | 5/2001 | Kich |
| 6,297,710 | B1 | 10/2001 | Cook et al. |
| 6,417,742 | B1 | 7/2002 | Enokuma |
| 6,496,084 | B1 | 12/2002 | Monte et al. |
| 6,677,911 | B2 | 1/2004 | Moheb |
| 6,842,085 | B2 | 1/2005 | Chen et al. |
| 6,904,394 | B2 | 6/2005 | Jaffrey |
| 7,019,603 | B2 | 3/2006 | Yoneda et al. |
| 7,236,681 | B2 | 6/2007 | Moheb et al. |
| 7,330,088 | B2 | 2/2008 | Aramaki et al. |
| 7,656,246 | B2 | 2/2010 | Mahon et al. |
| 7,772,940 | B2 | 8/2010 | Mahon et al. |
| 2004/0032305 | A1 | 2/2004 | Bohnet |
| 2004/0160292 | A1 | 8/2004 | Chen et al. |
| 2007/0210882 | A1 | 9/2007 | Mahon et al. |
| 2009/0251233 | A1 * | 10/2009 | Mahon et al. ..... 333/125 |

OTHER PUBLICATIONS

Perov, A.O., et al., Odhomode Transducers with a Common Circular Waveguide, Journal of Communications Technology and Electronics, 2007, vol. 52, No. 6, pp. 626-632.

* cited by examiner

ORTHO-MODE TRANSDUCER WITH WIDE BANDWIDTH BRANCH PORT

NOTICE OF COPYRIGHTS AND TRADE DRESS

A portion of the disclosure of this patent document contains material which is subject to copyright protection. This patent document may show and/or describe matter which is or may become trade dress of the owner. The copyright and trade dress owner has no objection to the facsimile reproduction by anyone of the patent disclosure as it appears in the Patent and Trademark Office patent files or records, but otherwise reserves all copyright and trade dress rights whatsoever.

BACKGROUND

1. Field

This disclosure relates to waveguide devices used to combine or separate two orthogonal modes, also known as ortho-mode transducers (OMTs).

2. Description of the Related Art

Satellite broadcasting and communications systems may use a first signal having a first polarization state for an uplink to a satellite and a second signal having a second polarization state, orthogonal to the first polarization state, for a downlink from the satellite. Note that two circularly polarized signals are orthogonal if the e-field vectors rotate in the opposite directions. The polarization directions for the uplink and downlink signals may be determined by the antenna and feed network on the satellite.

A common form of antenna for transmitting and receiving signals from satellites consists of a parabolic dish reflector and a feed network where orthogonally polarized modes travel in a common waveguide. The common waveguide may typically be cylindrical or square, but may be elliptical or rectangular.

An ortho-mode transducer (OMT) is a three-port waveguide device having a common waveguide coupled to two branching waveguides. An ortho-mode transducer may be used to launch or extract the orthogonal linearly polarized modes into or from the common waveguide of an antenna feed network.

In this patent, the term "cylindrical waveguide" means a waveguide segment shaped as a right circular cylinder, which is to say the cross-sectional shape of the waveguide segment is circular. Similarly, the terms "elliptical waveguide", "rectangular waveguide", and "square waveguide" mean a waveguide segment having an elliptical, rectangular, or square cross-sectional shape, respectively. In this patent, the term "generally rectangular waveguide" means a waveguide having an asymmetrical cross-section with two long sides and two short sides where at least a portion of each side is flat (not curved). A generally rectangular waveguide may have, for example, rounded internal corners, a septum extending between the two long sides or the two short sides, and/or ridges extending into the waveguide from one or more sides. In this patent, the term "ridged waveguide" means a generally rectangular waveguide with ridges, or conductive protrusions extending from two opposed sides of the waveguide. Within this patent, the term "port" refers generally to an interface between devices or between a device and free space. A port of a waveguide device may be formed by an aperture in an interfacial surface to allow microwave radiation to enter or exit a waveguide within the device.

The common waveguide of an OMT typically supports two orthogonal linearly polarized modes. Within this patent, the terms "support" and "supporting" mean that a waveguide will allow propagation of a mode with little or no loss. In a feed system for a satellite antenna, the common waveguide may be a cylindrical waveguide. The two orthogonal linearly polarized modes may be $TE_{11}$ modes which have an electric field component orthogonal to the axis of the common waveguide. When the cylindrical waveguide is partially filled with a dielectric material, the two orthogonal linearly polarized modes may be hybrid $HE_{11}$ modes which have at least some electric field component along the propagation axis. Two precisely orthogonal $TE_{11}$ or $HE_{11}$ modes do not interact or cross-couple, and can therefore be used to communicate different information.

The common waveguide terminates at a common port, which is to say that a common port aperture is defined by the intersection of the common waveguide and an exterior surface of the OMT.

Each of the two branching waveguides of an OMT typically supports only a single linearly polarized mode, which may be a $TE_{10}$ mode. The mode supported by the first branching waveguide is orthogonal to the mode supported by the second branching waveguide. Within this patent, the term "orthogonal" will be used to describe the polarization direction of modes, and "normal" will be used to describe geometrically perpendicular structures.

A traditional OMT, for example as shown in U.S. Pat. No. 6,087,908, has one branch waveguide axially aligned with the common waveguide, and one branch waveguide normal to the common waveguide. The branch waveguide that is axially aligned with the common waveguide terminates at what is commonly called the vertical port. The linearly polarized mode supported by the vertical port is commonly called the vertical mode. The branch waveguide which is normal to the common waveguide is terminated at what is commonly called the horizontal port. The branch waveguide that terminates at the horizontal port also supports only a single polarized mode commonly called the horizontal mode.

The terms "horizontal" and "vertical" will be used in this patent to denote the two orthogonal modes and the waveguides and ports supporting those modes. Note, however, that these terms do not connote any particular orientation of the modes or waveguides with respect to the physical horizontal and vertical directions.

DESCRIPTION OF THE DRAWINGS

Elements in the drawings are assigned reference numbers which remain constant among the figures. An element not described in conjunction with a figure may be presumed to be the same as a previously-described element having the same reference number.

DETAILED DESCRIPTION

Description of Apparatus

Figure 1:
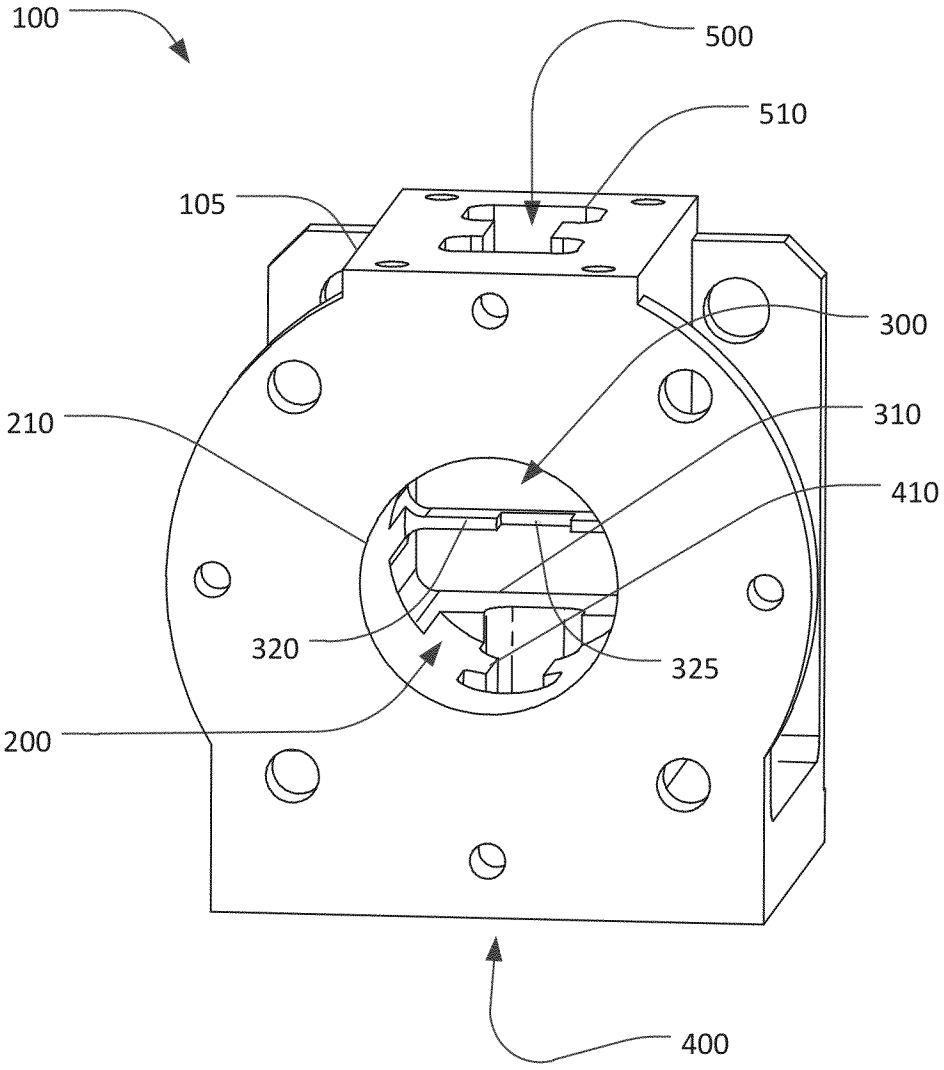
FIG. 1 is a perspective view of an OMT having a symmetry port and a septum.

FIG. 1 is a perspective view showing primarily the front and top of an exemplary ortho-mode transducer (OMT) 100. Throughout this patent, relative directional terms such as "top", "front", "back", "bottom", "left", "right", "up", and "down" refer to the OMT as shown in a particular figure and do not imply any absolute orientation of the OMT. The OMT 100 may be formed as a series of machined cavities within an OMT body 105. The OMT body 105 may be a conductive metal material such as aluminum, or a nonconductive material such as plastic with a conductive coating deposited on at least the interior surfaces of the OMT body 105.

The OMT 100 may include a common waveguide 210 that terminates at a common port 200 on the front surface of the OMT 100. In this example, the common waveguide 210 is a cylindrical waveguide. The common waveguide of an OMT may be cylindrical, elliptical, square, rectangular, or some other shape.

The OMT 100 may include a generally rectangular vertical branch waveguide 310 that terminates at a vertical port 300 on a back surface of the OMT 100. The vertical branch waveguide 310 and the vertical port 300 are partially visible through the common port 200. The vertical branch waveguide 310 may be configured to support a first $TE_{10}$ mode and to couple the first $TE_{10}$ mode into or from a first $TE_{11}$ mode in the common waveguide 210.

A septum 320 (partially visible through the common port 200) may extend between two short sides of the vertical branch waveguide 310 near the intersection of the vertical branch waveguide 310 and the common waveguide 210. The septum 320 may have a central stepped portion 325 having a smaller cross-section than the adjacent side portions of the septum 320.

The OMT 100 may include a generally rectangular horizontal branch waveguide 410 (partially visible through the common port 200) that terminates at a horizontal port 400 (not visible) on a bottom surface of the OMT 100. At least a portion of the horizontal branch waveguide 410 may be a ridged waveguide. The horizontal branch waveguide 410 may be configured to support a second $TE_{10}$ mode and to couple the second $TE_{10}$ mode into or from a second $TE_{11}$ mode within the common waveguide 210. A polarization direction of the second $TE_{10}$ mode may be orthogonal to a polarization direction of the first $TE_{10}$ mode. The terms "vertical" and "horizontal" do not imply any absolute orientation of the OMT 100.

The OMT 100 may include a generally rectangular symmetry waveguide 510 that terminates at a symmetry port 500 on the top surface of the OMT 100. At least a portion of the symmetry waveguide 510 may be a ridged waveguide. The symmetry waveguide 510 may be configured to support the first $TE_{10}$ mode and to couple the first $TE_{10}$ mode into or from the waveguide 210. The symmetry port 500 may be opposed to the horizontal port 400. The symmetry waveguide 510 may be in line with and coaxial with the horizontal branch waveguide 410. The symmetry port 500 may be closed by a shorting plate, not shown in FIG. 1, to create a closed cavity, which will be referred to herein as a "symmetry cavity".

Figure 2:
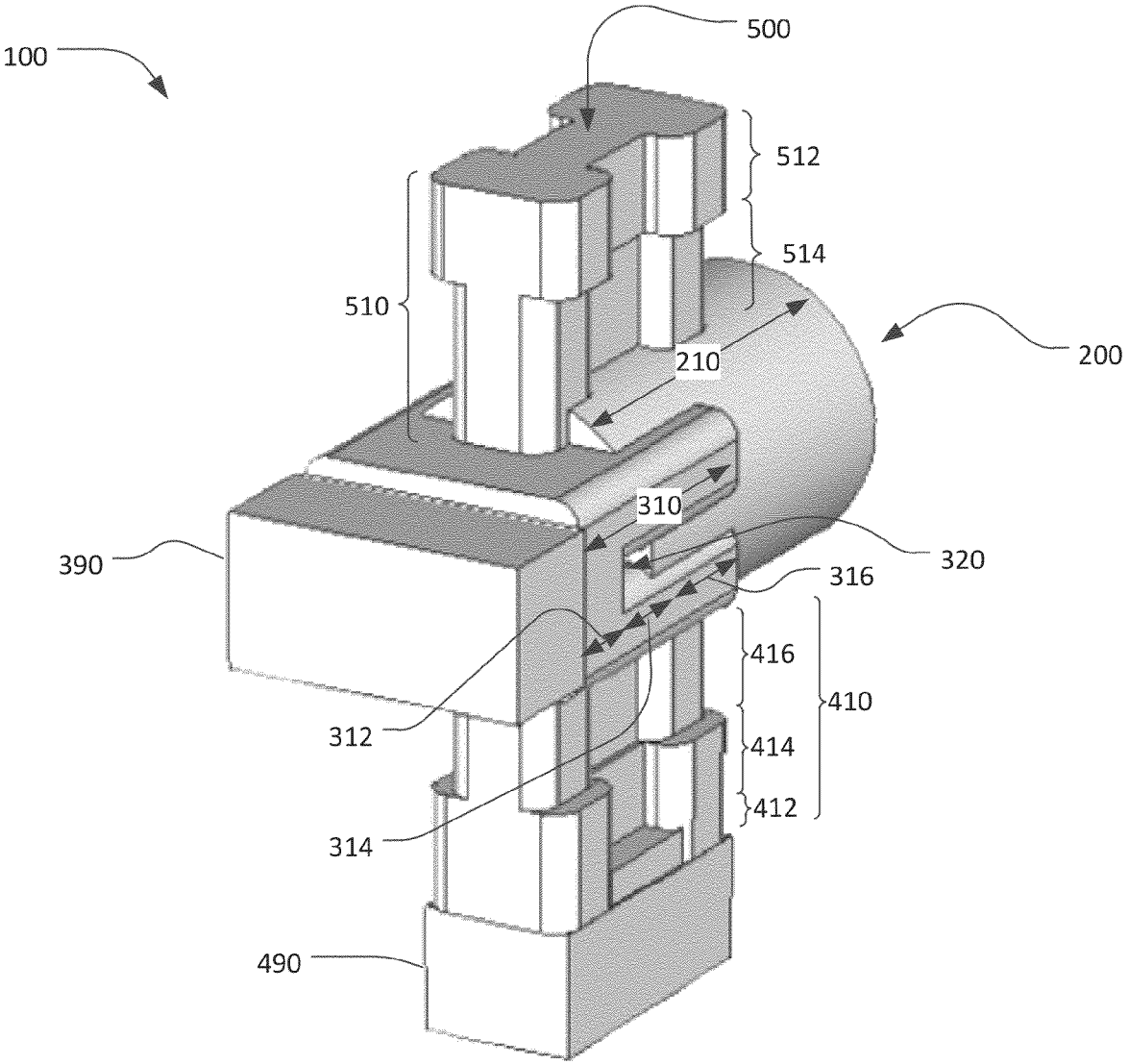
FIG. 2 is perspective view of the internal airspace within the OMT of FIG. 1.
Figure 3:
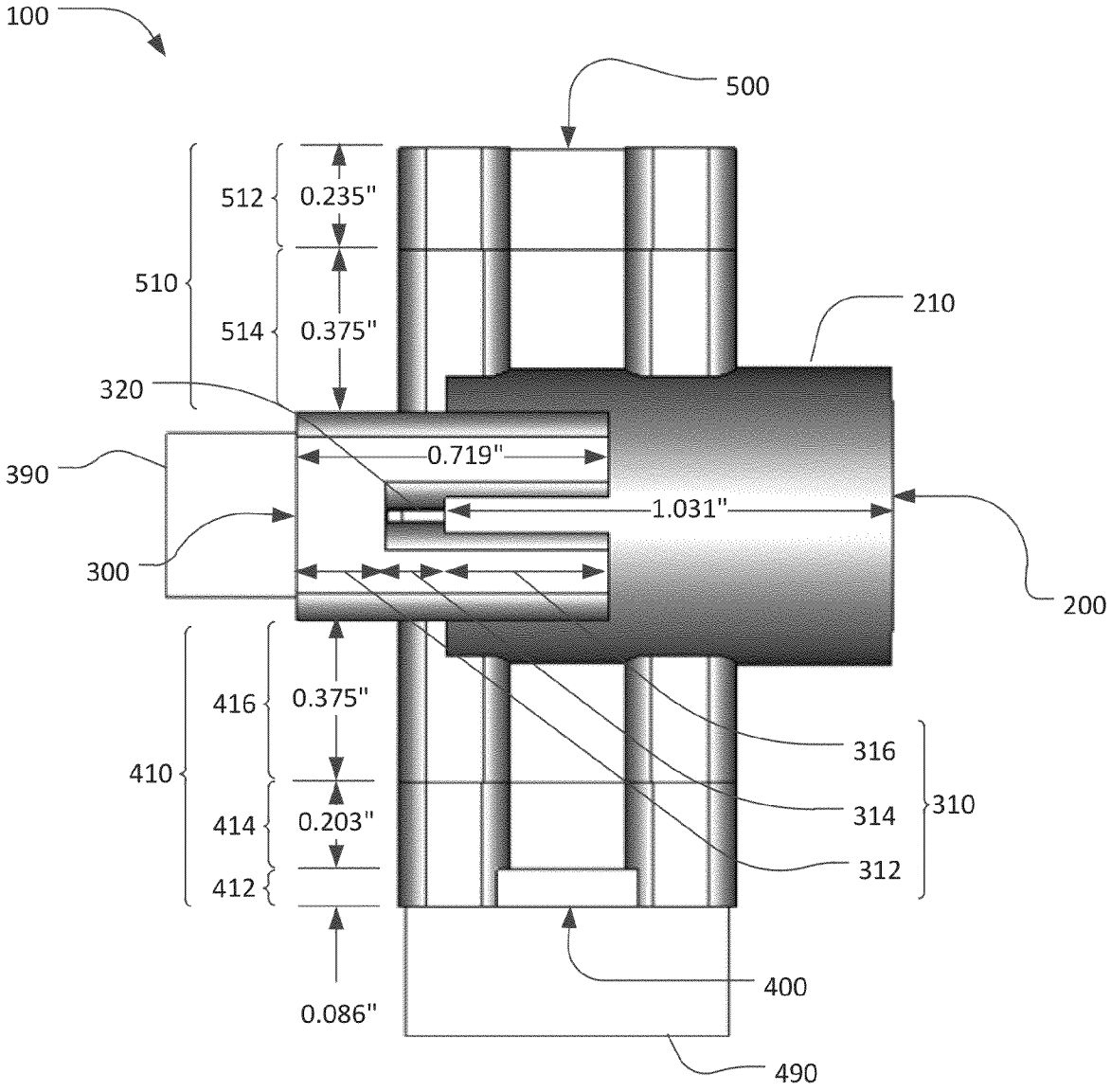
FIG. 3 is side view of the internal airspace within the OMT of FIG. 1.

The characteristics of an OMT such as the OMT 100 are determined by the geometry of the common waveguide, the vertical branch waveguide, the horizontal branch waveguide, and other structures internal to the OMT. It may be difficult to visualize the internal structure based on drawings of the exterior of an OMT. To aid in understanding the structure of the OMT 100, FIG. 2 and FIG. 3 show a perspective view and a side view, respectively, of the air space within the OMT 100. Both figures show the common waveguide 210, the vertical branch waveguide 310, the horizontal branch waveguide 410 and the symmetry waveguide 510, essentially with the OMT body surrounding theses waveguides removed.

FIG. 3 and subsequent figures provide dimensions of the waveguides within an embodiment of the OMT 100 where the return at the horizontal port is less than −20 dB over a frequency band of 10.7 GHz to 12.75 GHz and the return at the vertical port is less than −20 dB over a frequency band of 10.7 to 14.5 GHz. Thus the vertical port provides a wide bandwidth equal to 30% of the center frequency.

In FIG. 2, the common port 200 (not visible) faces generally away from the viewer, and the symmetry port 500 faces upward. The vertical port 300 (not identified in FIG. 2) faces generally towards the viewer but is obscured by a section of rectangular waveguide 390 coupled to the vertical port 300. Similarly, a section of rectangular waveguide 490 is coupled to the horizontal port (not visible). The rectangular waveguides 390 and 490 may be standard WR-750 waveguides (0.750"×0.375" waveguide dimensions).

In FIG. 3, the common port 200, the vertical port 300, the horizontal port 400, and the symmetry port 500 face right, left, down, and up, respectively.

The common waveguide 210 may have a circular cross-section over its entire length. The vertical branch waveguide 310 may include three segments. A first vertical branch waveguide segment 312, nearest the vertical port 300, may have a generally rectangular cross-section with rounded corners. A second vertical branch waveguide segment 314 may be split into two generally rectangular portions separated by the septum 320. The septum 320 may be centered on the shorter sides of the generally rectangular cross-section of the second vertical branch waveguide section 314.

A third vertical branch waveguide segment 316 may overlap a portion of the common waveguide 210. As will be discussed subsequently with respect to FIG. 9, the overlap of the third vertical branch waveguide segment 316 and the common waveguide 210 results in a waveguide cross-sectional shape that is a composite of the circular cross-section of the common waveguide 210 and the generally rectangular cross-section of the third vertical branch waveguide 316. The overlap of the third vertical branch waveguide segment 316 and the common waveguide 210 is instrumental in providing efficient coupling between the vertical port 300 and the common port 200 over a wide frequency range.

Continuing the discussion of FIG. 3, the horizontal branch waveguide 410 may include three segments including a first horizontal branch waveguide segment 412 nearest the horizontal port 400, a second horizontal branch waveguide segment 414, and a third horizontal branch waveguide segment 416 coupled to the common waveguide 210. Each of the first, second and third horizontal branch waveguide segments 412, 414, 416 may be a generally rectangular waveguide with rounded corners. One or more or all of the segments 412, 414, 416, may be ridged waveguides having wide ridges extending into the waveguide along the long sides of the generally rectangular shape, forming a narrowed waist region. This ridged waveguide cross-sectional shape is commonly referred to as a "dog bone" shape due to a resemblance to a well-known style of dog biscuit. The dog-bone cross-sectional shape of the first, second and third horizontal branch waveguide segments 412, 414, 416 is more clearly visible in FIGS. 6A and 6B.

Referring again to FIG. 3, the symmetry waveguide 510 may include two segments including a first symmetry waveguide segment 512 nearest the symmetry port 500, and a second symmetry waveguide segment 514 coupled to the common waveguide 210. One or both of the first and second symmetry waveguide segments 512, 514 may be ridged waveguides having a dog-bone cross-sectional shape. The dog-bone cross-sectional shape of the first and second symmetry waveguide segments 512, 514 is more clearly visible in FIGS. 7A and 7B.

An OMT, such as the OMT 100, may be designed such that the respective segments of the vertical branch waveguide 310, the horizontal branch waveguide 410, and the symmetry waveguide 510 having the largest cross-sectional areas are adjacent to the corresponding vertical, horizontal, or symmetry port. Additionally, an OMT may be designed such that the cross-sectional area of each succeeding waveguide segment is smaller than, and contained within, the cross-sectional area of the preceding waveguide segment. "Contained within" means that the entire perimeter of each succeeding waveguide section is visible through the aperture formed by the preceding waveguide section. With such a design, each waveguide section may be formed by machining through the aperture of the preceding waveguide section. Thus each waveguide section may be formed by a numerically controlled machining operation with an end mill or other machine tool, and the number of machining operation steps may be equal to the total number of waveguide segments.

The OMT 100 and other OMT devices designed according to the same principles may be formed in a series of machining operations without assembly or joining operations such as soldering, brazing, bonding, or welding. An OMT designed according to these principles may be formed from a single piece of material. The single piece may be initially a solid block of material. The OMT may be formed from a solid block of a conductive metal material such as aluminum or copper. The OMT may be also formed from a solid block of dielectric material, such as a plastic, which would then be coated with a conductive material, such as a film of a metal such as aluminum or copper, after the machining operations were completed. If justified by the production quantity, a blank approximating the shape of the OMT could be formed prior to the machining operations. The blank could be either metal or dielectric material and could be formed by a process such as casting or injection molding.

Figure 4B:
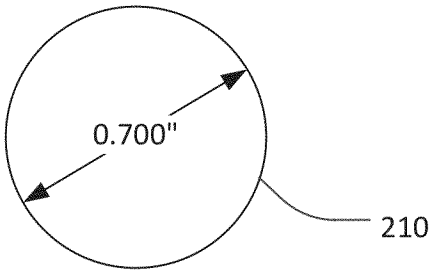
FIG. 4B is a partial plan view of the OMT providing dimensions of a common waveguide.
Figure 4A:
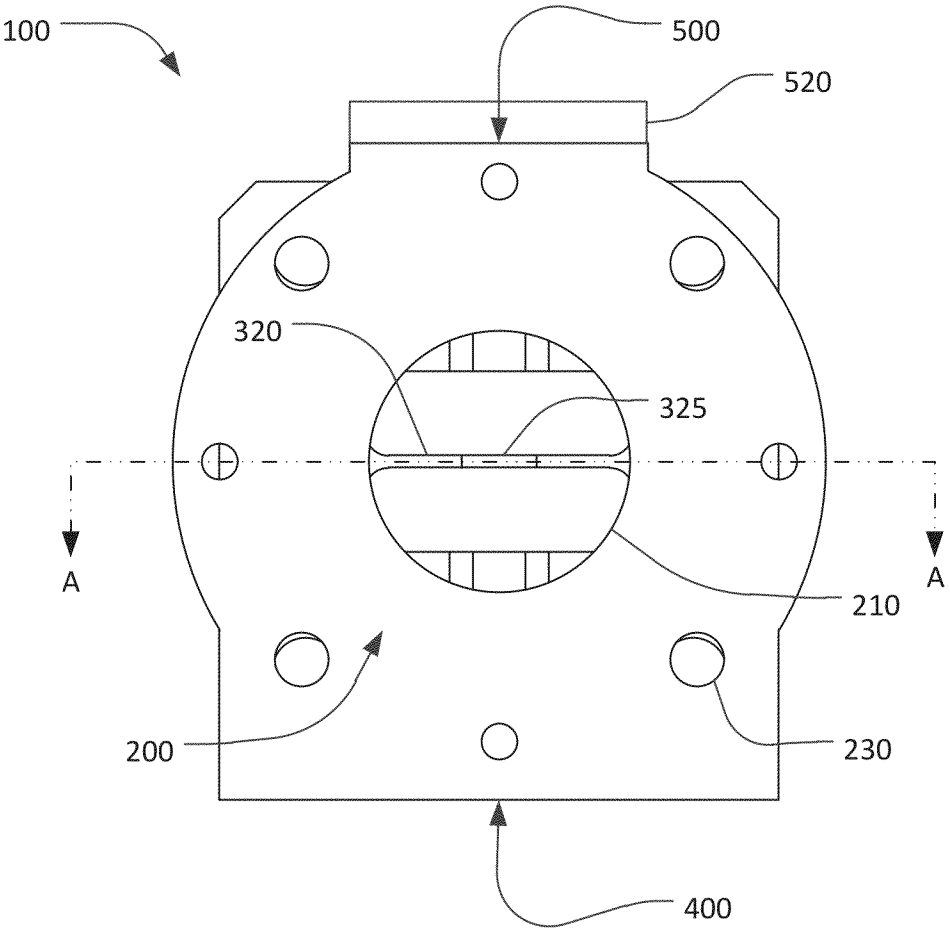
FIG. 4A is a plan view of the OMT looking into a common port.

FIG. 4A is a plan view of the OMT 100 looking normal to and into the common port 200. In this view the horizontal port 400 faces down and the symmetry port 500 faces up. A shorting plate 520 is attached to the symmetry port 500 to close the end of the symmetry waveguide to form a closed symmetry cavity (not visible). The septum 320, including the notched portion 325, is visible through the common port 200. A plurality of tapped or through holes 230 may be provided about the common port 200 to facilitate attachment of a waveguide or other device to the common port.

FIG. 4B provides a diameter of the common waveguide 210.

Figure 5B:
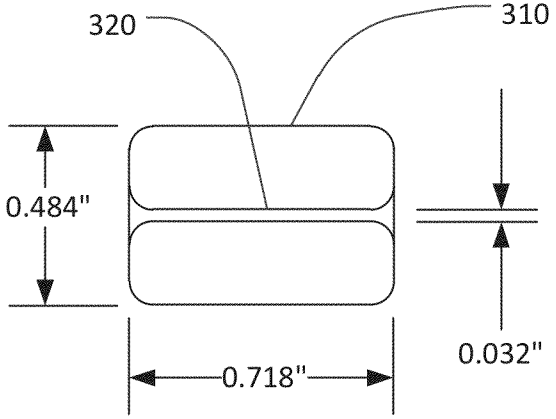
FIG. 5B is a partial plan view of the OMT providing dimensions of a vertical branch waveguide.
Figure 5A:
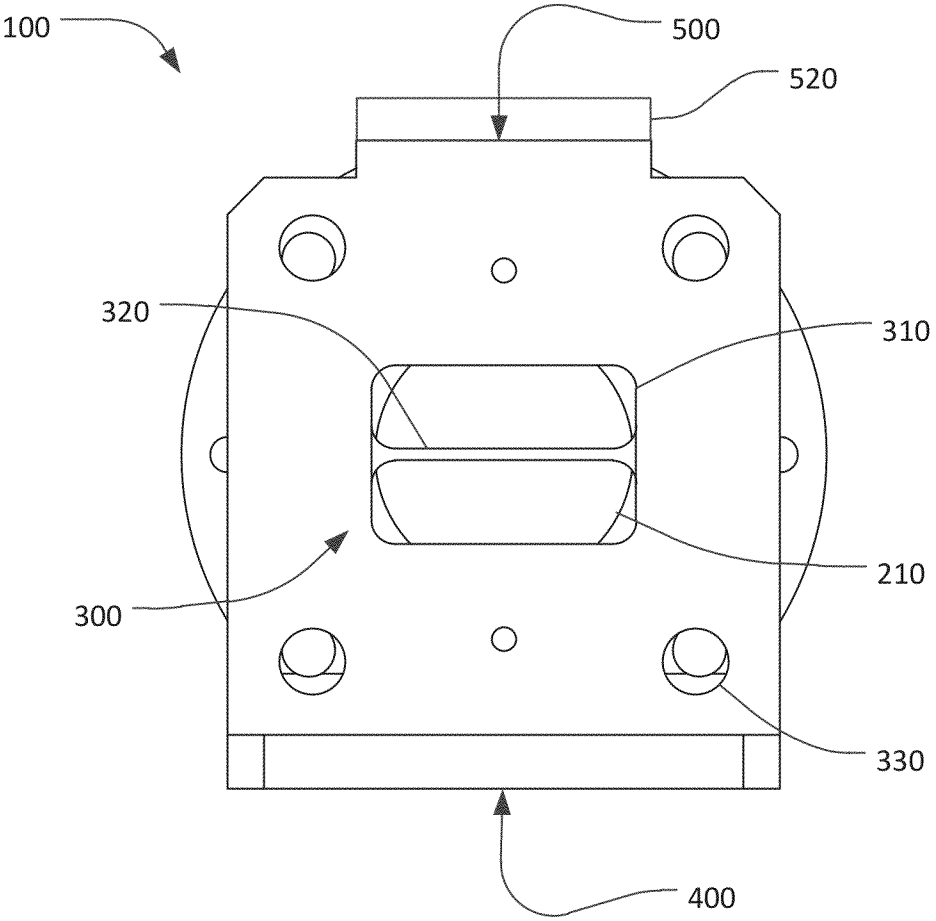
FIG. 5A is a plan view of the OMT looking into a vertical branch port.

FIG. 5A is a plan view of the OMT 100 looking normal to and into the vertical port 300. In this view the horizontal port 400 faces down and the symmetry port 500 faces up. The shorting plate 520 is attached to the symmetry port 500 to form the close symmetry cavity (not visible). The septum 320 and portions of the common waveguide 210 are visible through the vertical port 300. A plurality of tapped or through holes 330 may be provided about the vertical port 300 to facilitate attachment of a waveguide (such as the waveguide 390 shown in FIG. 2 and FIG. 3) or other device (not shown) to the vertical port 300.

FIG. 5B provides dimensions of the vertical branch waveguide 310 and the septum 320.

Figure 6B:
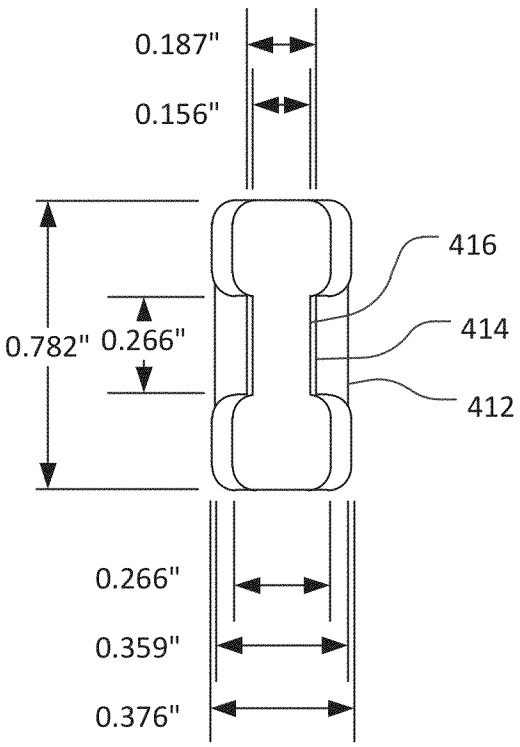
FIG. 6B is a partial plan view of the OMT providing dimensions of a horizontal branch waveguide.
Figure 6A:
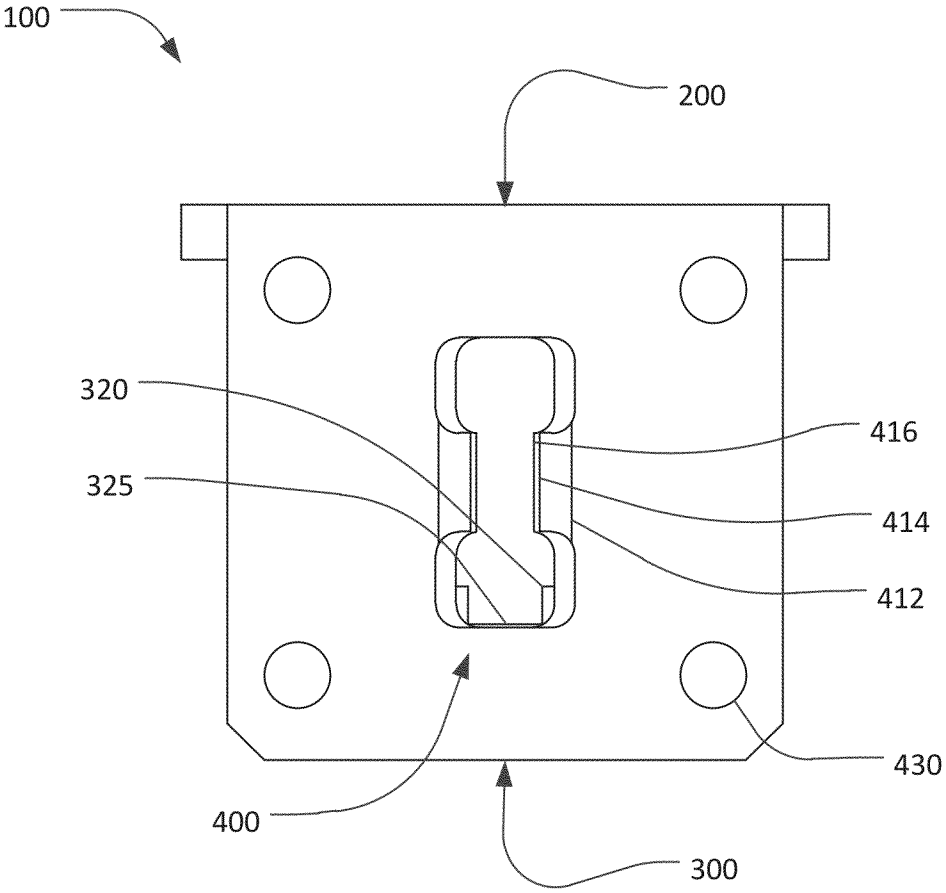
FIG. 6A is a plan view of the OMT looking into a horizontal branch port.

FIG. 6A is a plan view of the OMT 100 looking normal to and into the horizontal port 400. In this view the vertical port 300 faces down and the common port 200 faces up. The dog-bone cross-sectional shapes of the first, second, and third horizontal waveguide segments 412, 414, 416 are visible. The septum 320, including the notched portion 325, is partially visible through the horizontal port 400. A plurality of tapped or through holes 430 may be provided about the horizontal port 400 to facilitate attachment of a waveguide (such as the waveguide 490 shown in FIG. 2 and FIG. 3) or other device (not shown) to the horizontal port 400.

FIG. 6B provides dimensions of the first, second, and third horizontal waveguide segments 412, 414, 416.

Figure 7B:
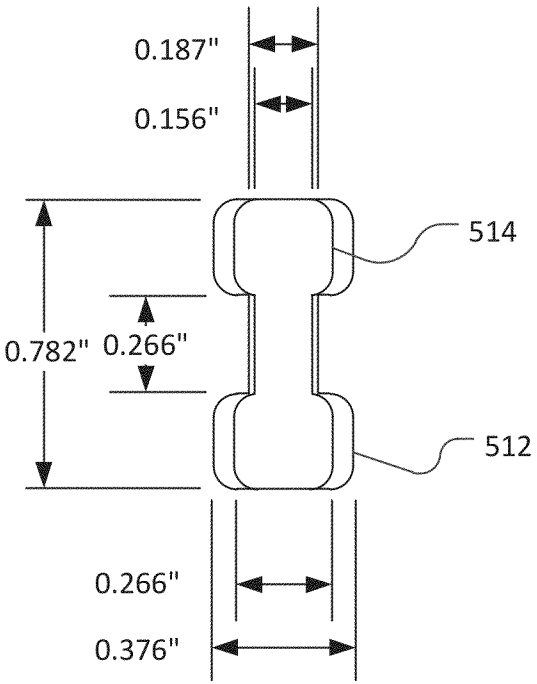
FIG. 7B is a partial plan view of the OMT providing dimensions of a symmetry waveguide.
Figure 7A:
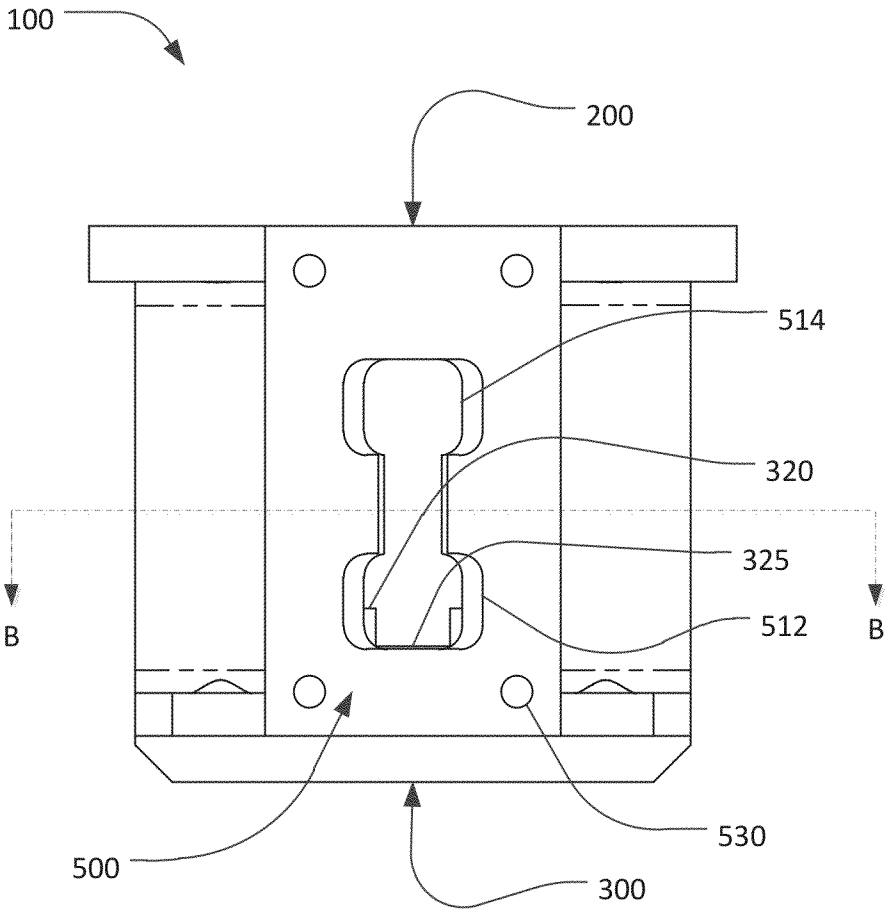
FIG. 7A is a plan view of the OMT looking into a symmetry port.

FIG. 7A is a plan view of the OMT 100 looking normal to and into the symmetry port 500. In this view the vertical port 300 faces down and the common port 200 faces up. The dog-bone cross-sectional shapes of the first and second symmetry waveguide segments 512, 514 are visible. The septum 320, including the notched portion 325, is partially visible through the symmetry port 500. A plurality of tapped or through holes 530 may be provided about the horizontal port 500 to facilitate attachment of a shorting plate (520 in FIG. 4A and FIG. 5A) to close the end of the symmetry waveguide.

FIG. 7B provides dimensions of the first and second symmetry waveguide segments 512, 514.

Figure 8:
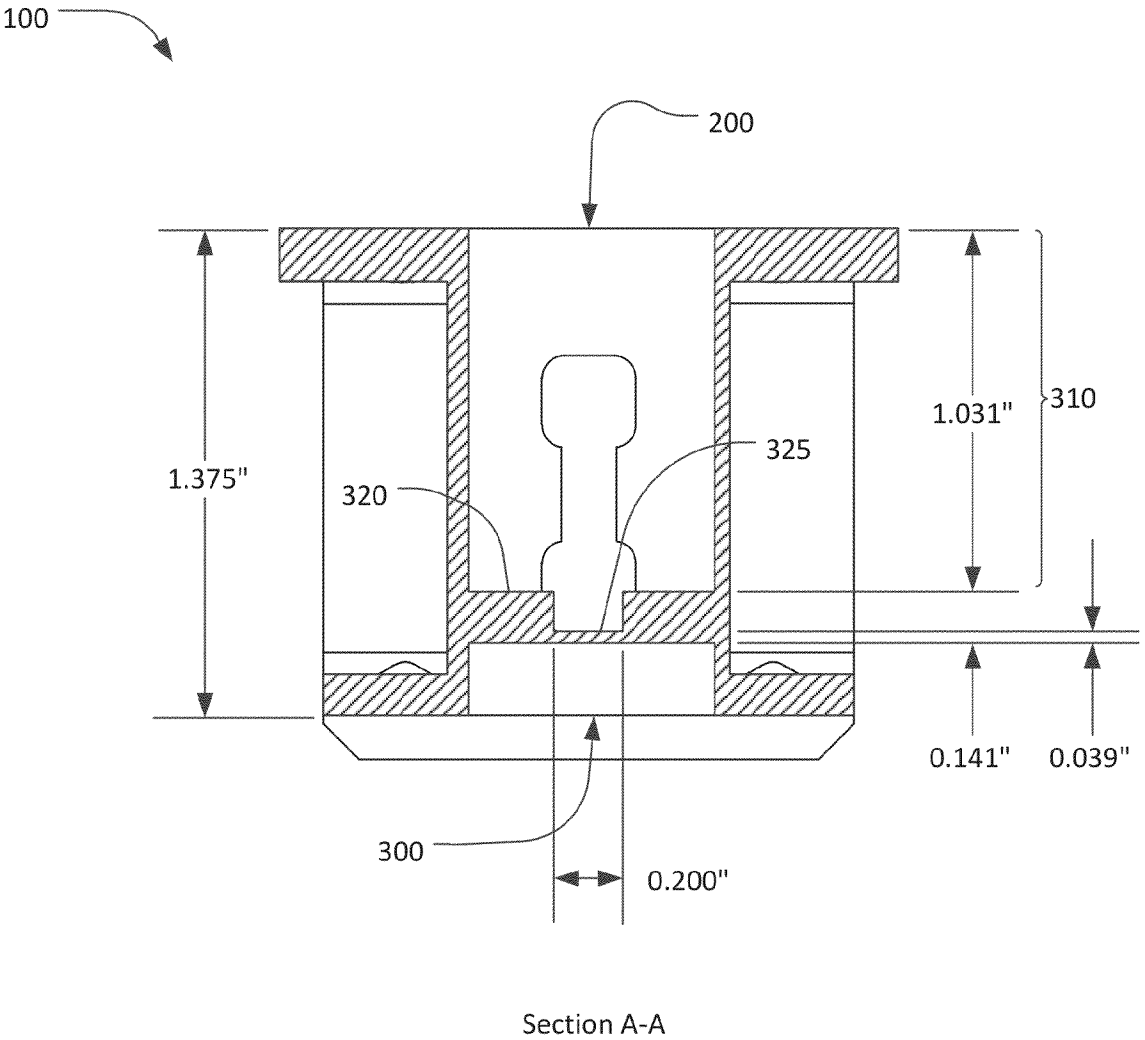
FIG. 8 is a cross-sectional view of the OMT at a section plane A-A defined in FIG. 4A.

FIG. 8 is a cross-sectional view of the OMT 100 along section plane A-A, which was defined in FIG. 4A. In this view, the common port 200 faces up and the vertical port 300 faces down. FIG. 8 shows details and dimensions of the septum 320 and the notched portion 325.

Figure 9:
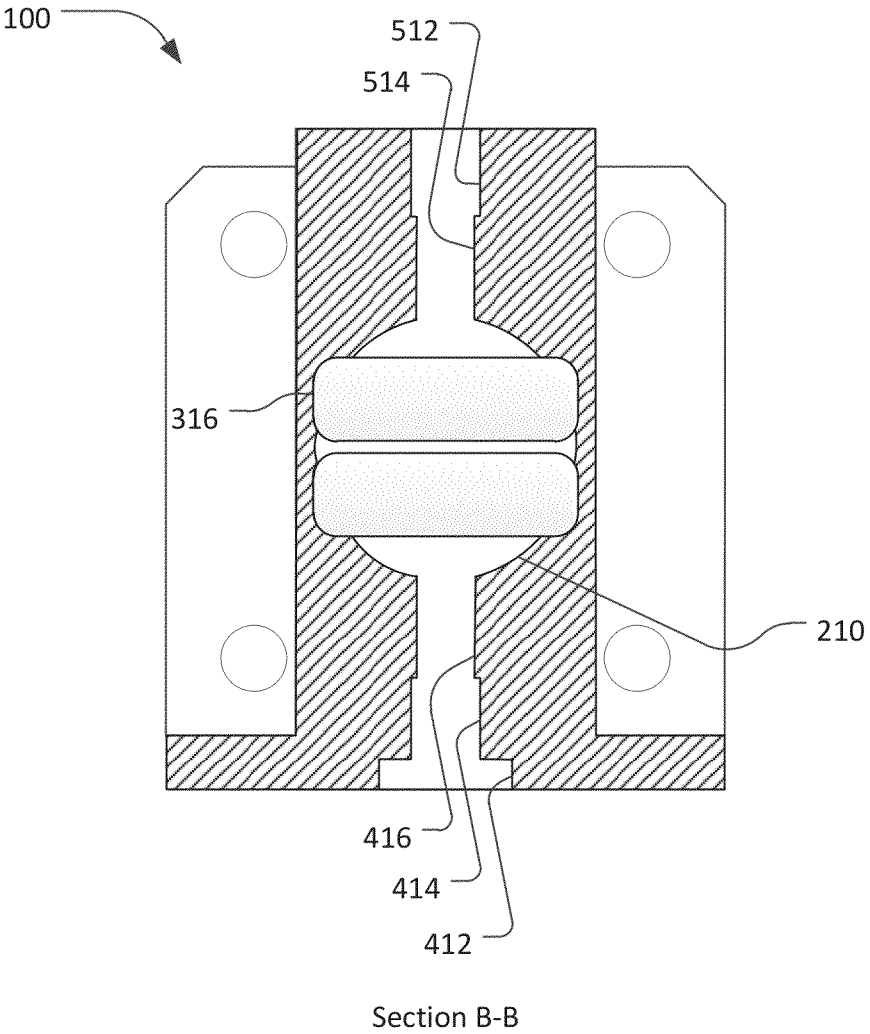
FIG. 9 is a cross-sectional view of the OMT at a section plane B-B defined in FIG. 7A.

FIG. 9 is a cross-sectional view of the OMT 100 along section plane B-B, which was defined in FIG. 7A. In this view, the symmetry port 500 (not identified) faces up and the horizontal port 400 (not identified) faces down. The first, second, and third horizontal branch waveguide segments 412, 414, 416 and the first and second symmetry waveguide segments 512, 514 are shown in cross-section. Section plane B-B transects the region of overlap between the third vertical branch waveguide segment 316 and the common waveguide 210. The cross-sectional shape of the overlapped region is a composite of the circular shape of the common waveguide 210 and the rectangular-with-rounded-corners shape of the third vertical branch waveguide segment 316.

An OMT, such as the OMT 100, may be designed using a commercial software package such as CST Microwave Studio. An initial model of the OMT may be generated with estimated dimensions for the common waveguide, horizontal branch waveguide, and vertical branch waveguide. The structure may then be analyzed, and the reflection coefficients and cross coupling may be determined for two orthogonal linearly polarized modes introduced respectively at the two branch ports. The dimensions of the model may then be iterated manually or automatically to minimize the reflection coefficients across an operating frequency band. As previously described, FIGS. 3-9 provide dimensions for an embodiment of the OMT for use in the frequency range of 10.7 to 14.5 GHz. These dimensions may be scaled (inversely with frequency) for operation in other different frequency bands.

Figure 10:
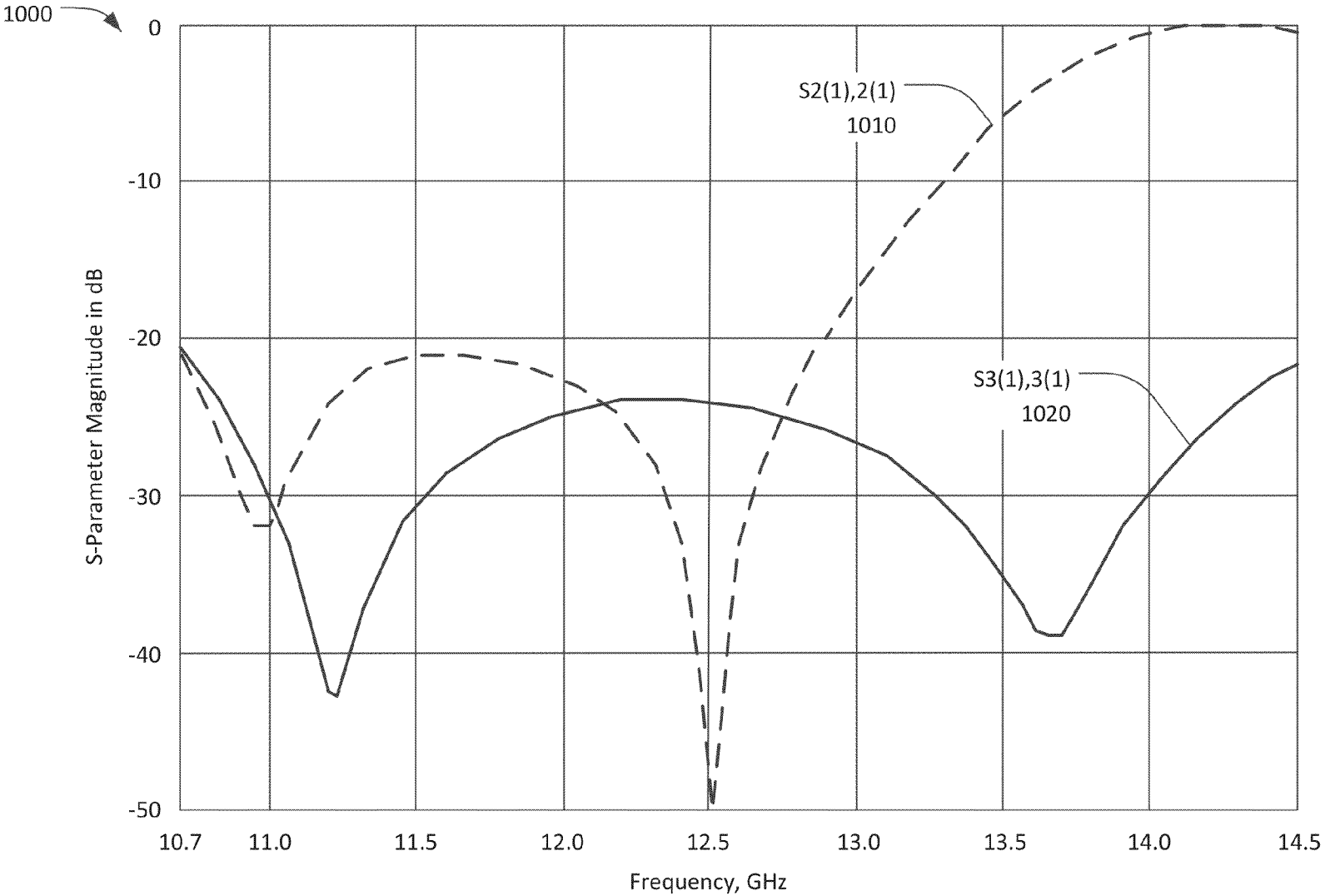
FIG. 10 is a graph showing the simulated performance of the OMT of FIGS. 1-9.

FIG. 10 is a graph 1000 illustrating the simulated performance of the exemplary OMT 100 as shown in FIGS. 1-9. The exemplary OMT 100 was designed for a specific application in a communications terminal wherein the horizontal port operates over a frequency band of 10.7 GHz to 12.75 GHz and the vertical port operates over a frequency band of 10.7 to 14.5 GHz. The performance of the exemplary OMT was simulated using finite integral time domain analysis. The time-domain simulation results were Fourier transformed into frequency-domain data as shown in FIG. 10.

The dashed line 1010 is a graph of the return S2(1),2(1) at the horizontal port of the OMT, and the solid line 1020 is a graph of the return S3(1),3(1) at the vertical port of the OMT. The return S2(1),2(1) is less than −20 dB, equivalent to a voltage standing wave ratio (VSWR) of 1.22, over the frequency range from 10.7 GHz to 12.75 GHz. The return S3(1),3(1) is less than −20 dB over the frequency range from 10.7 GHz to greater than 14.5 GHz. Thus the bandwidth of the vertical port is greater than 3.8 GHz or 30% of the center frequency of 12.6 GHz.

Closing Comments

Throughout this description, the embodiments and examples shown should be considered as exemplars, rather than limitations on the apparatus and procedures disclosed or claimed. Although many of the examples presented herein involve specific combinations of apparatus elements, it should be understood that those acts and those elements may be combined in other ways to accomplish the same objectives. Elements and features discussed only in connection with one embodiment are not intended to be excluded from a similar role in other embodiments.

For means-plus-function limitations recited in the claims, the means are not intended to be limited to the means disclosed herein for performing the recited function, but are intended to cover in scope any means, known now or later developed, for performing the recited function.

As used herein, "plurality" means two or more.

As used herein, a "set" of items may include one or more of such items.

As used herein, whether in the written description or the claims, the terms "comprising", "including", "carrying", "having", "containing", "involving", and the like are to be understood to be open-ended, i.e., to mean including but not limited to. Only the transitional phrases "consisting of" and "consisting essentially of", respectively, are closed or semi-closed transitional phrases with respect to claims.

Use of ordinal terms such as "first", "second", "third", etc., in the claims to modify a claim element does not by itself connote any priority, precedence, or order of one claim element over another or the temporal order in which acts of a method are performed, but are used merely as labels to distinguish one claim element having a certain name from another element having a same name (but for use of the ordinal term) to distinguish the claim elements.

As used herein, "and/or" means that the listed items are alternatives, but the alternatives also include any combination of the listed items.

It is claimed:

1. An ortho-mode transducer comprising:

a cylindrical common waveguide terminating in a common port;

a generally rectangular vertical branch waveguide in-line with the cylindrical common waveguide, the vertical branch waveguide terminating in a vertical port opposed to the common port, the vertical branch waveguide configured to couple a first linearly polarized mode from the vertical port to the common waveguide, a portion of the vertical branch waveguide overlapping a portion of the cylindrical common waveguide to form a waveguide segment having a cross-section that is a composite of a circular cross-section of the common waveguide and a generally rectangular cross-section of the vertical branch waveguide;

a septum spanning a long dimension of the vertical branch waveguide proximate to the overlapping portions of the vertical branch waveguide and the common waveguide;

a generally rectangular horizontal branch waveguide normal to the common waveguide and the vertical branch waveguide, the horizontal branch waveguide terminating in a horizontal port, the horizontal branch waveguide configured to couple a second linearly polarized mode from the horizontal port to the common waveguide, the second linearly polarized mode orthogonal to the first linearly polarized mode; and a generally rectangular symmetry cavity opposed to the horizontal branch waveguide.

2. The ortho-mode transducer of claim 1, wherein the horizontal branch waveguide comprises:

a first horizontal branch waveguide segment terminating in the horizontal port;

a third horizontal branch waveguide segment coupled to the common waveguide; and a second horizontal branch waveguide segment coupled between the first horizontal branch waveguide segment and the third horizontal branch waveguide segment.

3. The ortho-mode transducer of claim 2, wherein a cross-sectional shape of the third horizontal branch waveguide segment is contained within a cross-sectional shape of the second horizontal branch waveguide segment, and the cross-sectional shape of the second horizontal branch waveguide segment is contained within a cross-sectional shape of the first horizontal branch waveguide segment.

4. The ortho-mode transducer of claim 3, wherein one or more of the first, second, and third horizontal branch waveguide segments is a ridged waveguide.

5. The ortho-mode transducer of claim 2, wherein one or both of the first and second symmetry waveguide segments is a ridged waveguide.

6. The ortho-mode transducer of claim 1, wherein the symmetry cavity comprises:

a first symmetry waveguide segment terminating in a symmetry port;

a second symmetry waveguide segment coupled between the first symmetry waveguide segment and the common waveguide; and a shorting plate closing the symmetry port.

7. The ortho-mode transducer of claim 6, wherein a cross-sectional shape of the second symmetry waveguide segment is contained within a cross-sectional shape of the first symmetry waveguide segment.

* * * * *